United States Patent [19]

Morrison et al.

[11] Patent Number: 4,957,171

[45] Date of Patent: Sep. 18, 1990

[54] PNEUMATIC DRILL

[75] Inventors: Ward D. Morrison; Arthur A. Michaud, both of Claremont, N.H.

[73] Assignee: Cannon Industries, Inc., Claremont, N.H.

[21] Appl. No.: 341,777

[22] Filed: Apr. 24, 1989

[51] Int. Cl.[5] ..... B25D 9/18

[52] U.S. Cl. ..... 173/104; 173/134; 173/163

[58] Field of Search ..... 173/104, 109, 111, 134, 173/163

[56] References Cited

U.S. PATENT DOCUMENTS 3,858,666 1/1975 Bailey et al. ..... 173/105 X 4,340,121 7/1982 Bailey et al. ..... 173/134

*Primary Examiner*—Hien H. Phan

*Assistant Examiner*—Scott A. Smith

*Attorney, Agent, or Firm*—Michael J. Weins

[57] ABSTRACT

A pneumatic rock drill which has a pneumatic percussion unit with a piston which slidably engages the cylinder in which it reciprocates. Preferably clearances of less than less than about 0.00125 inches per inch of piston diameter and greater than about 0.00075 inches where clearances are diameter are maintained to assure a fluid film between the piston and the cylinder wall. The clearances are based on diameters. The piston of the pneumatic drill has at least one stem section which slidably engages a distributor. The rock drill has a pneumatic motor connected to the percussion unit and engages a distributor of the percussion unit. An air motor gear in the pneumatic motor is rotatably mounted on the distributor. The exhaust is employed to lubricate the bearings and gearing which turn the striker bar.

11 Claims, 6 Drawing Sheets

PNEUMATIC DRILL

DESCRIPTION

1. Field of Invention

The present invention is directed to a pneumatic drill and more particularly to a drill which has a percussion unit with a piston which slidably engages the cylinder in which it reciprocates.

2. Background Art

There are numerous pneumatic drills employed for rock drilling. These drills having various components and widely differing configurations. U.S. Pat. No. 3,858,666 teaches a drill having a percussion unit with a single stem piston. The stem has air passageways therein to control the flow of compressed air which is used to reciprocate the piston. Drills so valved are known as valveless drills.

U.S. Pat. No. 4,243,110 discloses another valveless drill and employes a percussion unit. This drill employs a two stem piston. Both of the above drills have an in-line percussion unit, air motor, and striking bar. However since the piston is double valved the inherent length of the drill is longer than that of single stem drills of similar cross-section and stroke.

U.S. Pat. No. 4,340,121 is a valveless drill of the double stem variety which is forshortened compared to the drill of the '110 Patent. The forshortening being accomplished by offsetting the air motor percussion unit. The reduction in length is obtained at the expense of the overall diameter of the drill One of the disadvantages of the double stem drills is that they generally are heavier than single stem drills in part because they are not as compact.

The pistons which are employed in percussion units are frequently defined as thick or thin head pistons depending on the ratio of the thickness of the piston head to its diameter. The pistons employed in the percussion unit for drills classically are designed as thick head pistons as illustrated in the '666 and '110 Parents. The thick head pistons distribute any load imparted by the piston to the cylinder permitting small clearances between the cylinder and the piston. The disadvantage of this design is it requires massive pistons which absorb large quantities of energy in the non-productive back stroke of the piston.

U.S. Pat. No. 3,991,835 eliminates the requirement of a thick piston by providing a continuous open space between the piston and the cylinder in which it reciprocates. The patent defines a piston as a thin head piston when the ratio of the thickness to diameter is less than about 0.17 to 1. Support for the piston is provided by a stem section of the piston which slidably engages a bearing surface to direct the motion of the piston.

The lighter piston reduces the energy expended in the back stroke of the piston as well as allowing an increase in the frequency of operation resulting from the reduction in the piston mass.

There is commercially available a rock drill produced by Sullivan Industries which has an offset air motor and incorporates many features taught in the '121 Patent. The uses a thin head having its thickness to diameter less than 0.22 thus being less than the minimum value for thick pistons as taught in the '835 Patent. The ratio is similar in appearance to the piston illustrated in the '121 Patent. A continuous open space is provided between the piston and the cylinder as taught in the '835 Patent. The piston is supported by distributors which slidably engage the piston stems. This drill has met with commercial success and provides rapid cutting rates. However these drilling rates are obtained at the expense of air consumption. Thus there is a need for a more air efficient pneumatic drill with enhanced performance.

SUMMARY OF INVENTION

It is an object of the present invention to provide a pneumatic rock drill with rapid cutting rates and reduced air consumption.

It is another object of the present invention to provide a percussion unit for a rock drill with greater penetrating power than currently available percussion units.

Still another object of the present invention is to provide a light compact drill having a pneumatic motor and percussion unit.

Yet another object of the present invention is to provide a pneumatic rock drill wherein all or a portion of the motor exhaust and leakage air is employed to lubricate the bearings, gear train, chuck assembly, and striker bar of the drill.

The rock drill of the present invention employs a percussion unit having a piston which slidably engages a cylinder. By slidably engaging it is meant that the piston and cylinder are engaged in a bearing relationship and that contact between the surfaces is generally avoided by an intermediate fluid film.

In order to assure a fluid film between the two surfaces it is preferred that clearances of less than about 0.00125 inches per inch of diameter of the piston should be maintained. This limit will assure that a fluid layer will be maintained to avoid metal to metal contact. A lower limit of 0.00075 inches should be maintained to avoid irregularities in the surfaces traversing the fluid layer. These clearances are expressed in terms of diameters and thus are twice the wall to piston clearance.

The rock drill of the present invention has a percussion unit, air motor, and a striker bar which are axially aligned.

The percussion unit has a cylinder block having a central passage there through and terminating at a first block end and a second block end. A reciprocating piston has a central section which slidably engages the central passage in the block. The piston has a first stem section and a second stem section having cross sections which are reduced in area with respect to the cross section of the central section of the piston. The central section of the piston partitions the central passage into a first volume and a second volume.

A first distributor having a distributor passage there through contoured to slidably engage the first stem section of the piston and attaches to the first end of the block. The first distributor serves to support the first stem section of the piston. The distributor also cooperates with the movement of a necked down region of the first stem section of the piston to control the distribution of air to the first volume of the central passage.

A second distributor having a distributor passage there through slidably engages the second stem section of the piston. The second distributor is positioned at the second end of the block. The second distributor performs parallel functions with respect to the movement of a necked down region of the second stem section and the distribution of air to the second volume as does the first distributor. The second distributor is supported by a first plate through which it passes.

It is preferred that the material for the surfaces of central passage of the cylinder of block and the distributors passages through the first distributor and the second distributor be a bearing material chosen to mitigate galling in the event that the fluid film breaks down between the piston and the central passage. The piston is preferably made of a high alloy steel having its surface hardened to avoid deformation when impacting the striker bar. It is preferred that for such a piston the surface of the central passage and the distributors which engage the pistons be bearing materials such as bronze or applied coatings compatible with a hardened steel Coatings of this type can be applied by techniques such as electro-deposition, chemical deposition, or ion implantation.

In a preferred embodiment the cylinder block, and the distributors are ductile iron with the surfaces engaging the piston machined exposing a microstructure suitable to serve as a bearing surface for the piston. A ferritic ductile iron has been found to perform well in service for this application. The cylinder being a bearing material allows for sliding contact rather than requiring clearances even with pistons with thin central sections. The bearing material provides a self lubricating surface in the event of a breakdown of the fluid film between the surfaces. The use of ductile iron is felt to provide an additional benefit by providing dampening capacity to the block which may in part assist in the ability to reduce clearances and maintain sliding contact.

The cylinder block of the percussion unit is provided with exhaust ports which provide for selectively exhausting the first volume and the second volume of the central passage as the piston reciprocates.

In one preferred embodiment a backhead is provided which attaches to the first distributor and is contoured to provide a reservoir between the backhead and the first distributor. The volume of the reservoir should be of sufficient size to provide air on demand and to dampen pressure fluctuations.

The reservoir is connected to the first distributor by one or more first distributor air passageways and to the second distributor by one or more second distributor air passageways. Preferably the second distributor air passageways pass through the cylinder block.

In another preferred embodiment of the drill of the present invention the second distributor air passageways are contained in the cylinder block and provide sufficient volume to supply air on demand and dampen pressure fluctuations thereby serving as a reservoir and negating the need for a separate reservoir.

An air motor has a passage there through which allows the mounting of the air motor around the second distributor. An air motor gear of the air motor is axially aligned with the piston and is rotatably mounted on the second distributor which preferably serves as a race for a bearing for the air motor gear.

The air motor gear engages a drive gear generating a joint tooth profile. A motor housing having a first end surface and a second end surface has a central passage connecting the end surfaces. The first end surface of the motor housing is attached to the first plate which holds the second distributor. The first plate may optionally have a wear plate interposed between it and the motor housing. The first plate and optional wear plate are provided with a hole for a bearing for supporting a shaft on which the drive gear rotates.

The central passage of the air motor housing surrounds the joint tooth profile and is in close proximity to the tooth profile except where the teeth of the gears engage. A first open region and a second open region are formed between the joint tooth profile and the motor housing in the vicinity where the teeth of the gears engage. These regions are preferably symmetrically displaced with respect to the engaged teeth.

A second plate which is a replaceable wear plate, having a first hole and a second hole is attached to the second end surface of the air motor and covers the second end surface of the air motor and the central passage.

The air motor has a first air inlet and a second air inlet opening into respectively the first open region and the second open region. When the motor is run in the forward direction air is directed into the first open region through the first air inlet. Air exits from the second air inlet maintaining the second open region at a reduced pressure with respect to the first open region.

Optionally exhaust ports are provided to further aid in the removal of air from the air motor central chamber. A first exhaust port is positioned over the teeth of the air motor gear away from the teeth engaged with the drive gear, while the second exhaust port is positioned over the teeth of the drive gear away from the teeth engaged with the air motor gear. The exhaust ports may be in the first plate or the wear plate.

The chuck drive assembly, pinion gear, gear train, and a bearing support for the shaft or journal rotatably supporting the drive gear are contained in a main housing. The main housing, which optionally can be integral with the wear plate, is attached to the motor housing. The chuck assembly contains a chuck axially aligned with the piston and is rotatably mounted in the main housing. A chuck gear surrounds the chuck, is axially aligned with the chuck and engages the cluster gear completing the drive train which rotates the chuck.

A splined striker bar slidably engages the chuck drive assembly accommodating translational motion introduced by the piston while transmitting the rotational motion of the chuck to the striker bar. It is preferred that the chuck have a bushing and a chuck driver between the chuck and the striker bar. These parts can be changed when worn and in this way extend the life of the chuck. The chuck and the chuck driver are provided with rotational locking means to limit rotation between the chuck and the chuck driver.

BEST MODE FOR CARRYING THE INVENTION INTO PRACTICE

Figure 1:
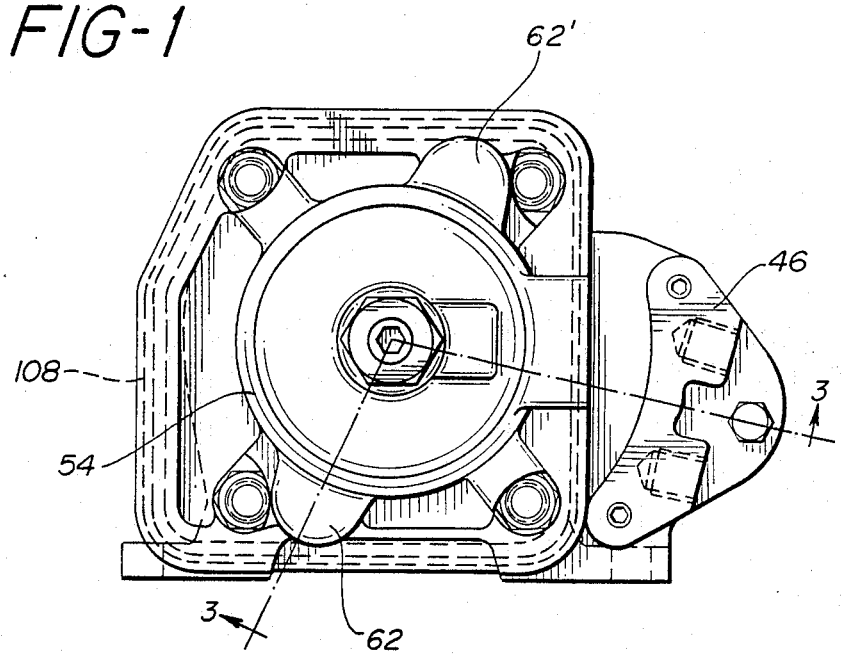
FIG. 1 is an end view of one embodiment of the drill of the present invention illustrating the back head.
Figure 2:
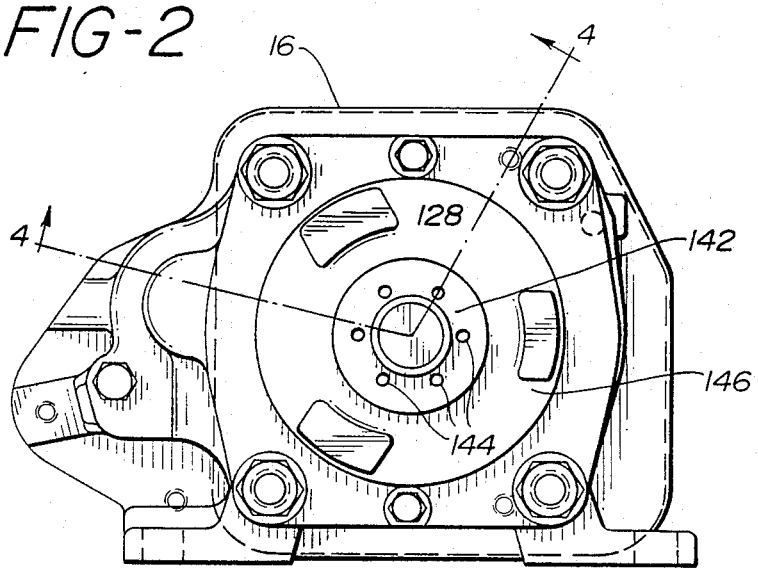
FIG. 2 is a second view illustrating the striker bar end of the drill.

FIGS. 1 through 6 illustrate various views of one embodiment of the present invention. A drill 10 is composed of three principal components. A percussion unit 12, an air motor 14, and a main housing 16 containing a drive train 18 and a chuck assembly 20.

The percussion unit 12 has a piston 22 which reciprocates in a cylinder block 24. The cylinder block 24 has a first block end 26 and a second block end 28. The piston 22 has a central section 30 with a cross section which slidably engages a central passage 32 in the cylinder block 24. The central section 30 of the piston 22 partitions the central passage 32 into a first volume V1 and a second volume V2. The cylinder block 24 is provided with exhaust ports 33 which provide for exhausting the first volume V1 and the second volume V2 as the piston 22 reciprocates.

The piston 22 has a first stem section 34 and a second stem section 36 which are smaller in cross section than the cross section of the central section 30.

A first distributor 38 has a first distributor passage 40 which slidably engages the first stem section 34 of the piston 22. The first distributor 38 attaches to the first end 26 of the cylinder block 24 closing the first end of the central passage 32. A second distributor 42 has a second distributor passage 44 which slidably engages the second stem section 36 of the piston 22. The second distributor 44 is supported by a first end plate 46 which attaches to the second end 28 of the cylinder block 24 and closes the second end of the central passage 32. The second distributor 42 extends beyond the first plate end 46. Preferably the first end plate 46 is made of heat treatable steel to assure a combination of strength and ductility which will withstand the stresses and strains resulting from force fitting the second distributor 42 in the first plate 46.

The piston 22 has necked down regions 48 and 50 which are respectively on the first stem section 34 and the second stem section 36 of the piston 22. These necked down regions cooperate with the distributors providing a timed supply of air to the volumes Vl and V2 of the central passage 32.

The cooperation of the movement of the necked down region of the end segments and the distributors is further discussed in the '121 Patent in column 2 lines 31–64 and is incorporated herein by reference. Percussion units valved in this manner are frequently referred to as valveless percussion units since they have no valves in the cylinder block.

Figure 3:
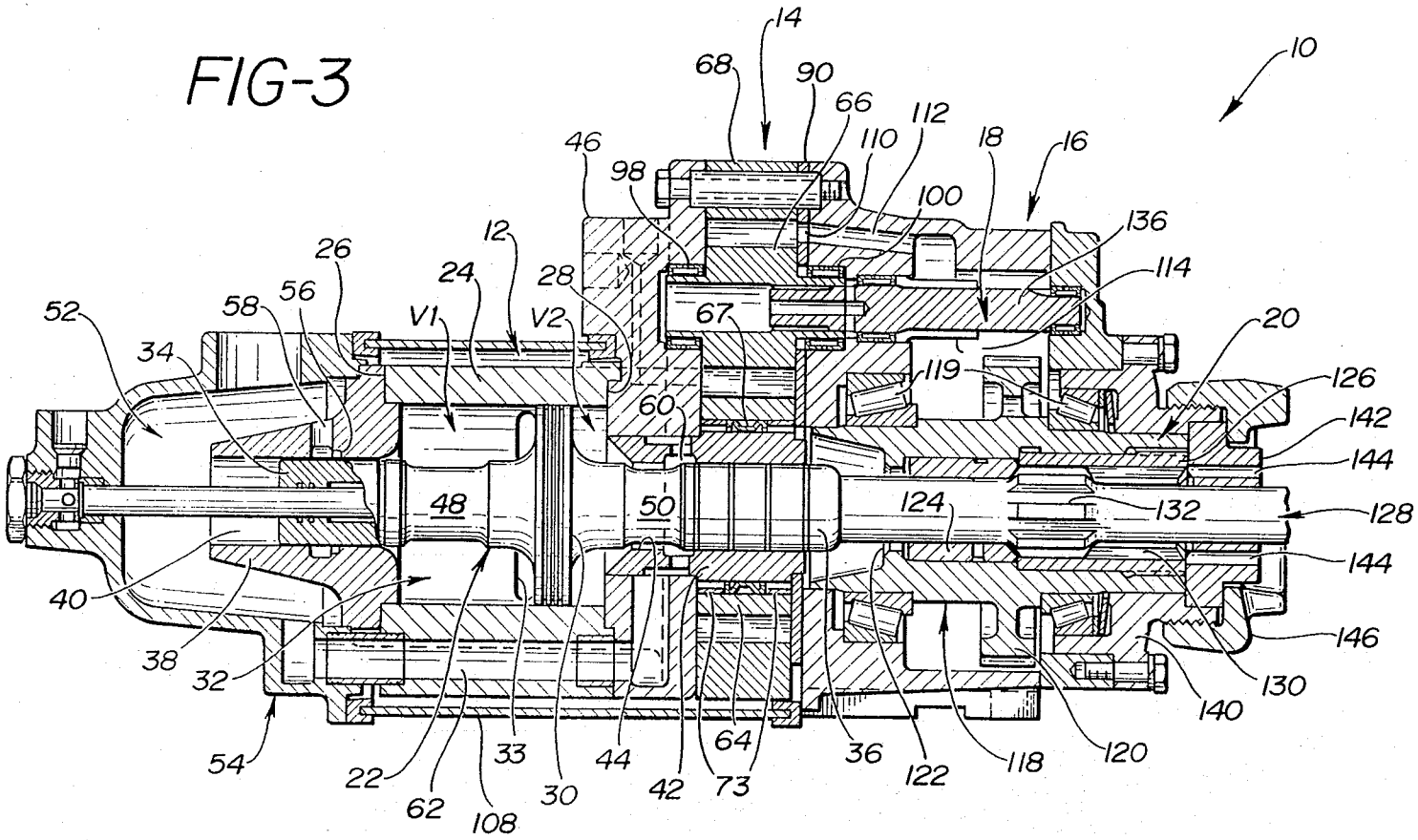
FIG. 3 is a cross section 3—3 of FIG. 1. The relative position of the back head, cylinder block, air motor, main housing, gear train, and chuck assembly are illustrated.

An air reservoir 52 is formed between the first distributor 38 and a back head 54 which attaches to the first distributor 38. The reservoir 52 communicates with a first distributor port 56 in the first distributor 38 via one of more first distributor air passageways 58. The reservoir 52 communicates with a second distributor port 60 via one or more second distributor air passageways 62 one of which is shown in FIG. 3. An additional second distributor air passageway 62' is further illustrated in FIG. 1.

Referring again to FIGS. 1 through 6 it is further preferred that when the piston be a high alloy steel which is case hardened the surfaces of the distributors which slidably engages the stem sections and the cylinder block which slidably engages the central piston section be a bearing material compatible with hardened steel. While bearing materials have been employed in pneumatic drills for support rings which slidably engage stem sections of a piston, the piston cylinders have employed hardened steel surfaces. This gives rise to an interface not well suited to sliding contact. Such an interface will require either very light loads be maintained requiring thick pistons or if thin pistons are employed provide continuous open spaces between the piston and cylinder resulting in an increase in air consumption and a decrease in the efficiency of the percussion unit.

It is still further preferred that the cylinder block and the two distributors be ductile iron with the surfaces which are in sliding contact with the piston being machined surfaces. The microstructure of these machined surfaces are suitable to serve as a bearing surface for the hardened steel of the piston. Furthermore it is felt that the damping capacity of the ductile iron may in part account for the reduction in clearances that can be employed with ductile iron.

The second distributor 42 extends beyond the first plate 46 and passes into the air motor 14 where it serves as a shaft for the air motor gear 64. This results in a reduction in overall length of the drill 10. Although a length reduction can be obtained by offsetting the motor this results in an increase in cross section of the drill and a corresponding increase in weight.

Having the second distributor 42 ductile iron is also preferred since it allows the outer surface of the second distributor 42 to be hardened by surface treatments such as induction or flame hardening without affecting the bearing surface of the second distributor 42. The hardened surface serves as a bearing race on which a motor bearing 67 is supported.

Figure 5:
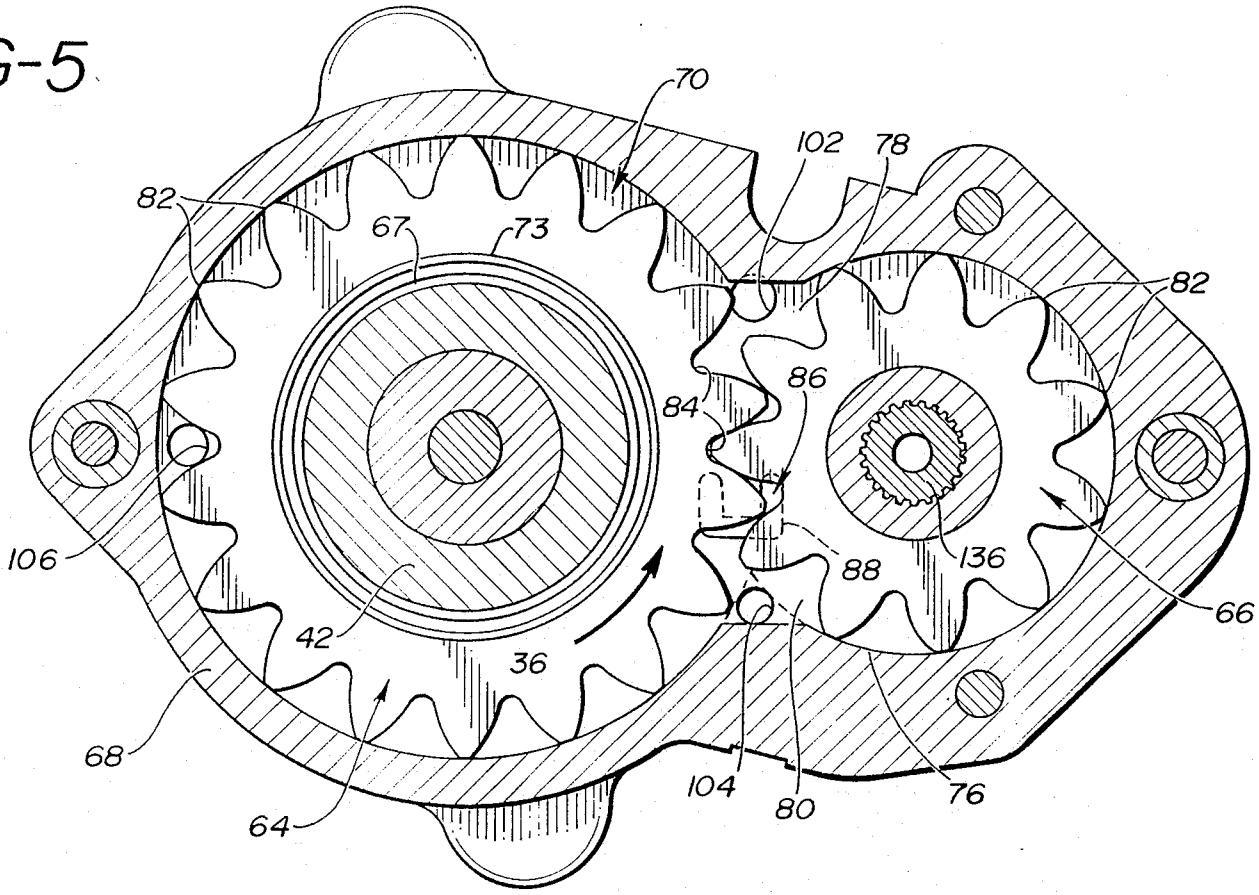
FIG. 5 is a cross section view of the air motor showing a gear tooth profile and a pressure relief channel for air compressed in the volume enclosed by the tooth tip-root region of engaged teeth.
Figure 6:
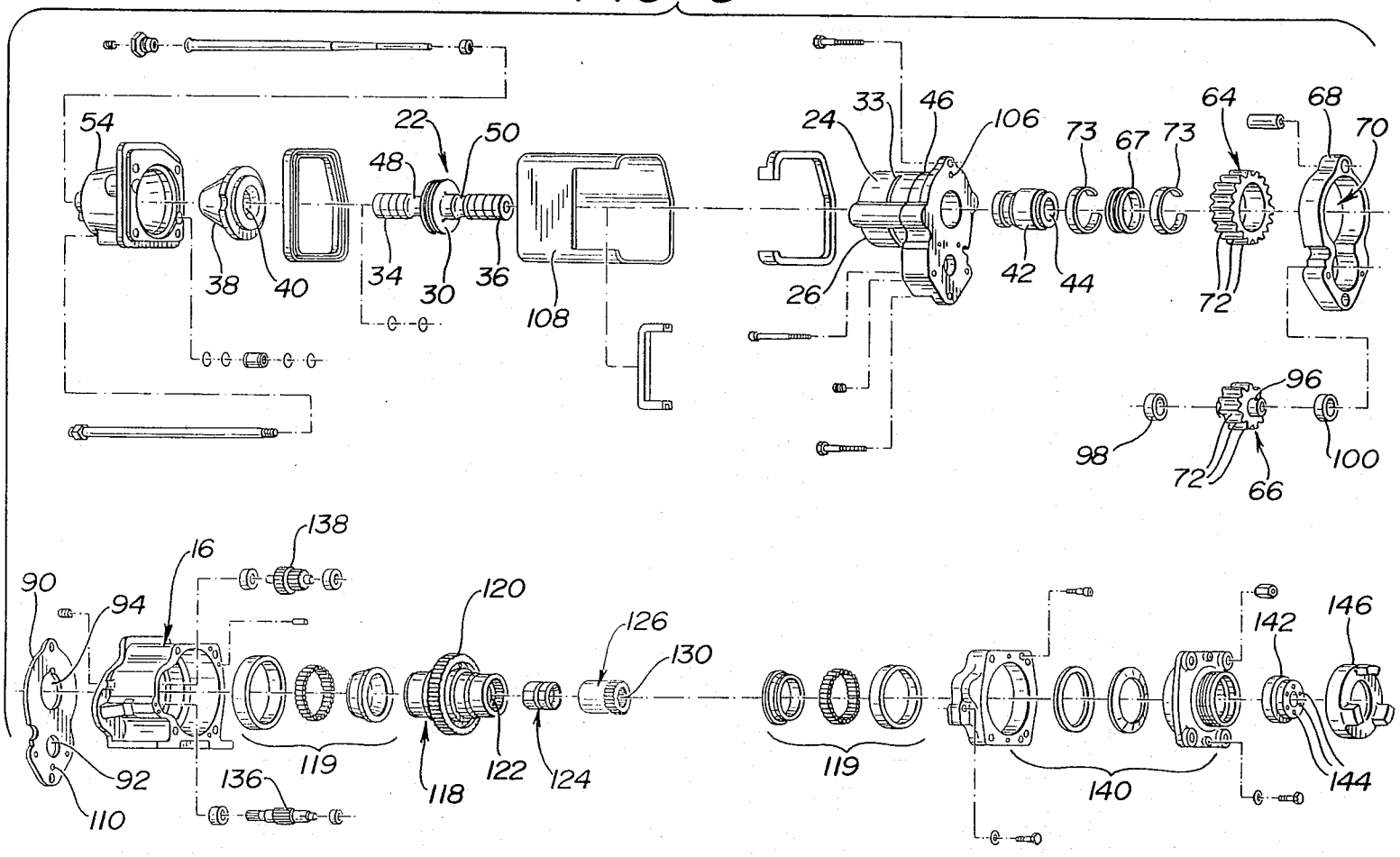
FIG. 6 is an exploded view of the drill as shown in FIGS. 1-5 showing the interrelationship of the elements of the pneumatic drill.

An air motor housing 68 attaches to the first plate 46 and has a central passage 70 illustrated in FIG. 6 which accommodates the motor gear 64 and the drive gear 66. The air motor gear turns the drive gear 66 by engaging teeth 72 of the gears. Referring to FIG. 5 the central passage 70 surrounds the air motor gear 64 and the drive gear 66 which are engaged and generate a joint profile 76. The central passage 70 follows in close proximity the joint profile 76, diverging from the profile only in the neighborhood of the engaged teeth to provide a first open region 78 and a second open region 80. These open regions are symmetrically disposed with respect to the engaged teeth.

The teeth of the air motor gear 64 and the drive gear 66 have truncated tips 82 which follow the contour of the wall of the cavity 70 and mesh with the roots 84 of the teeth. The pressure build-up in the tip-root volume 86 as the teeth engage is reduced by a side wall channel 88 which vents the compressed air to the open region 80 of the air motor 14.

Referring to FIG. 6 the central passage 70 of the motor housing 68 is covered by a second plate, a wear plate 90. The wear plate 90 has a first hole 92 through which the drive shaft 96 of the drive gear 66 passes. A second hole 94 is provided in the wear plate through which the second distributor 42 and second stem section 36 passes.

To assure centering of the air drive gear it is preferred that the air motor gear bearing 67 is centered and preferably positioned between two spacers 73 to prevent shifting during operation. The air motor gear bearing 67 when centered allows the air motor gear 64 to adjust with respect to the first plate 46 and the wear plate 90. The ability of the air motor gear 64 to make adjustments with respect to the first plate 46 and the wear plate 90 allows minimization of the leak rate thereby increasing the efficiency.

The drive shaft journals 96 for the drive gear 66 are held by a first bearing 98 and a second bearing 100. The first bearing 98 is mounted in the first plate 46 and the second bearing is mounted in the main housing 16. A first air inlet 102 provides air to the first open region 78. The air drives the motor 14 in one direction. As shown in FIG. 5 the motor will operate in the forward direction when the gear 64 is turning counter-clockwise when viewed looking into the figure. When the motor 14 is run in the forward direction the first open region 78 receives air and second region 80 is vented by the second air inlet 104. A relief channel 88 vents to the second volume 80 which is the low pressure volume. The relief channel 88 provides vent for the tip-root volume reducing the compression of gas trapped therein. Since the motor 14 is run in reverse only for the limited purpose of uncoupling elements it is not of great concern that the pressure will not be as effectively reduced in the tip-root volume 86. The second air inlet 104 provides air to the second open region 80 for driving the motor 14 in the reverse direction.

Preferably exhaust ports are provided to assist in exhausting the air supplied to the motor 14. The exhaust ports are positioned over the teeth of the air motor gear 64 and the drive gear 66 and are positioned away from the engaged teeth of these gears.

It is preferred that at least one of the exhaust ports exhausts lubricated air to the main housing 16 providing lubrication to the gear train 18 and the chuck assembly 20. It is further preferred that the air motor 14 have exhaust configured such that a first motor exhaust port 106 passes through first plate 46. The first motor exhaust port 106 is over the air motor gear 64 and is positioned adjacent to the teeth of the air motor gear 64 and away from the gear teeth engaged with the drive gear 66. The motor exhaust port 106 passes through the first plate 96 and exits near the cylinder block 34 and within the confines of a muffler 108 which surrounds the cylinder block 24. The muffler 108 baffles the noise from the exhaust ports 33 of the percussion unit 12 as well as from the first air motor exhaust port 106.

A second air motor exhaust 110 is positioned over the teeth of the drive gear 66 which are away from the teeth of the drive gear 66 which engage with the air motor gear 64.

The second exhaust port 110 opens into an exhaust conduit 112 in the main housing 16. The main housing 16 is attached to the air motor 14. The exhaust conduit 112 provides lubricated air under pressure to a main housing cavity 114 which houses the gear train 18 and the chuck drive assembly 20.

The chuck assembly 20 has a chuck 118 axially aligned with the axis of the piston 22. The chuck 118 is connected to a chuck gear 120 and is rotatably mounted on bearing 119. The chuck 118 has a central bore 122 which accommodates a bushing 124 and a chuck driver 126 into which a striker bar 128 passes. The chuck driver 126 is provided with groves 130 which engage splines 132 on the striker bar 128 which allows axial motion while limiting rotational motion between the striker bar 128 and the chuck driver 126. The chuck driver 126 and a portion of the chuck central bore 122 have interlocking mating surfaces which engage so as to prevent rotation there between.

Figure 4:
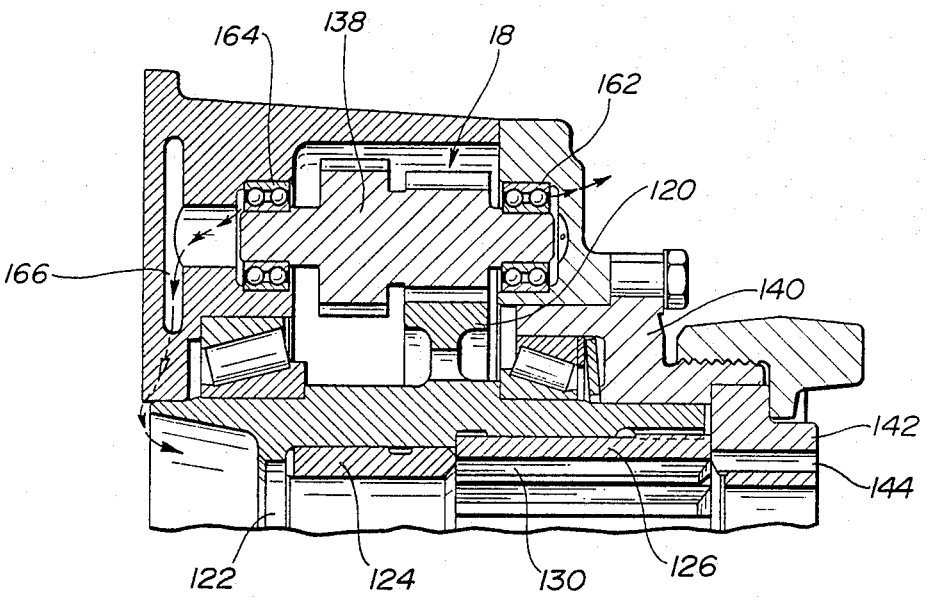
FIG. 4 is a section along 4—4 of FIG. 2 showing a cluster gear engaged with a chuck gear which rotates a chuck.

The chuck assembly 20 is turned by the gear train 18. One such train is depicted in FIGS. 3 and 4. The gear train 18 shown has a pinion gear 136 which is driven by the drive gear 66. The pinion gear 136 drives a cluster gear 138 which in turn drives the chuck gear 120 and imparts rotational motion to the chuck 118. The chuck assembly is held in place by a chuck cover assembly 140 which attaches to the main housing 16.

The striker bar 128 is held in the chuck assembly by a bushing 142 provided with vents 144. The bushing 142 fits in the chuck cover assembly 140 and is secured by a cap 146.

The vents 144 in the bushing 142 maintains the chuck bore 122 at a slight positive pressure with respect to the atmosphere, but substantially less than the pressure in the housing cavity. This pressure differential between the housing cavity 114 the chuck bore 122 is assured by maintaining controlled limited clearance between main housing 16 and the chuck assembly 118.

Figure 7:
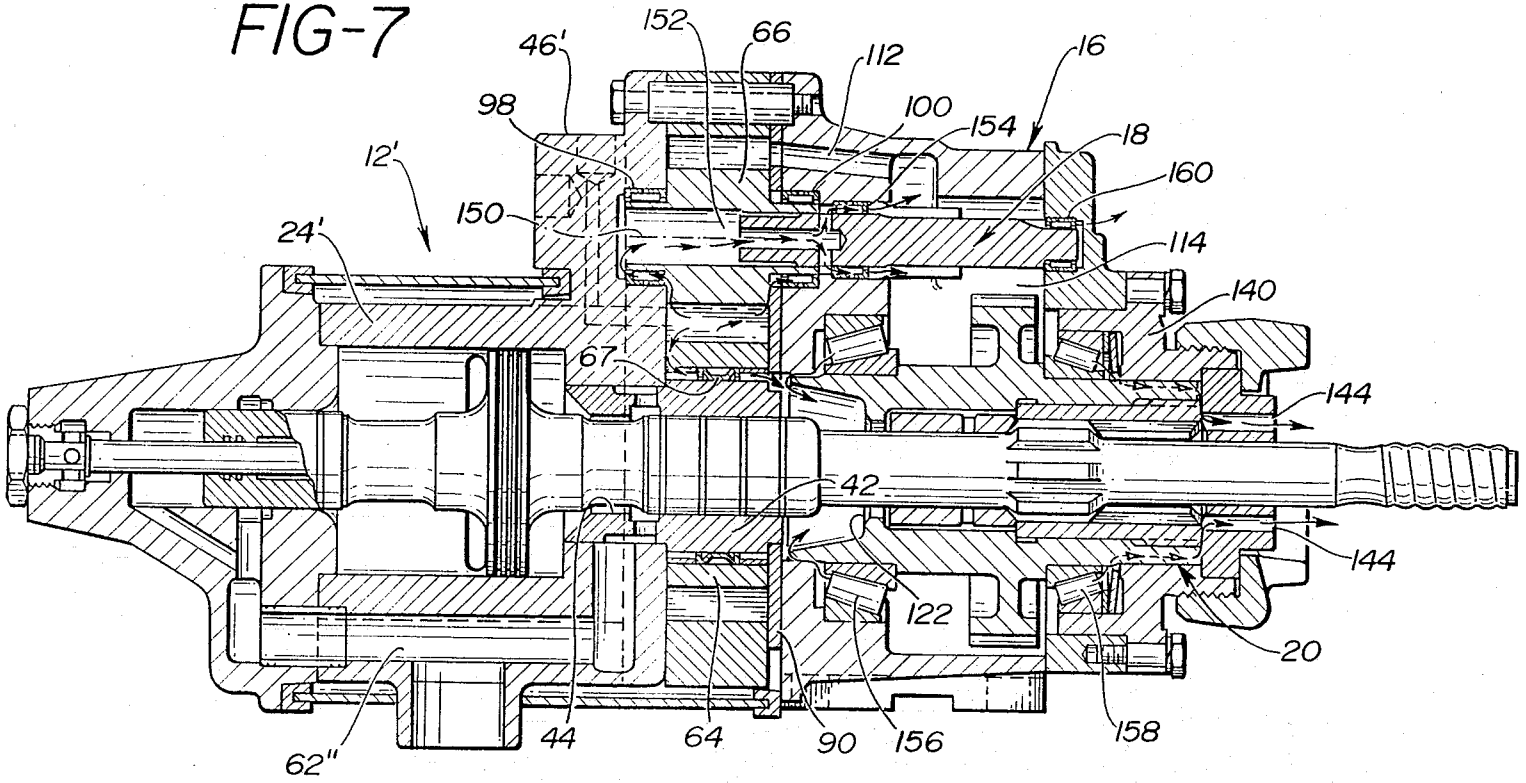
FIG. 7 is a second embodiment where the passages in the cylinder block serve as air reservoirs to provide air on demand and to dampen pressure fluctuations.

FIG. 7 illustrates a second embodiment of a drill with a percussion unit 12' where the second distributor passages 62'' are of sufficient size to serve as a reservoir and provide air on demand and dampen any pressure fluctuations. With the passages so configured the reservoir 52 of the earlier discussed embodiment can be eliminated. The reservoir 52 (as illustrated in FIG. 3) can also be eliminated if an air hose of sufficient size is employed FIG. 7 also illustrates a cylinder block 24' and a first plate 46' which are formed as a single unit. It is preferred that the cylinder and the plate be separate when the block is ductile iron A heat treatable steel plate is preferably employed since the combination of strength and ductility can be obtained which will readily withstand stresses associated with the force fit used to couple the second distributor 42 to the first plate 46. The motor motor 14 and main housing 16 with its associated drive train 18 and chuck assembly 20 are the same as in the embodiment shown in FIG. 3.

The air motor gear 64 of the drill illustrated in FIG. 7 is supported by a central bearing 67, while the drive gear 66 is supported by a first drive gear bearing 98 and a second gear bearing 100. A positive flow of lubricated air is maintained through these bearings by leakage paths between the motor gears and the first plate 46 and the wear plate 90. When the drill is run in the forward direction there is a pressure drop between pressurized open region 78 (shown in FIG. 6) and the second distributor 42 as well as between the open region 78 and the axis 150 of the drive gear 66. A pressure drop is assured for air motor gear 64 by venting the central passage of the air motor gear 64 to the central bore 122 of the chuck assembly 20. The central bore is maintained near atmospheric pressure by vents 144.

Similarly a pressure drop is maintained for the drive gear 66 by providing an air passage 152 which passes air from the axis 150 to the main housing cavity 114 via the pinion gear bearing 154. The path of the air flow for the bearings is illustrated by arrows. The main housing cavity also receives lubricated air from the exhaust conduit 112. A pressure differential is maintained between the main housing cavity 114 and the central bore 122 of the chuck assembly 20 by controlling the clearances between the chuck drive assembly 20 and the main housing 16 as well as between the chuck assembly 20 and the chuck cover assembly 140. Lubrication of the chuck assembly bearings 156 and 158 is assisted by having the bearings along the controlled clearance paths between the chuck drive assembly 20 and the main housing 16, and between the chuck assembly 20 and the chuck cover assembly 140

The remaining bearing in the assembly are either vented to the atmosphere or to the central bore 122. The pinion gear bearing 160 is provided with a vent hole allowing the air to escape to the atmosphere.

Also the cluster gear bearing 162 shown in FIG. 4 is vented to the atmosphere. The remaining cluster gear bearing 164 is vented to the central bore 122 by the channel 166.

What we claim:

1. An improved valveless pneumatic drill having a percussion unit with a cylinder block having a central passage with a piston reciprocating therein between a first and a second distributor, a pneumatic motor, and a main housing containing a chuck drive assembly having a rotating chuck for engaging a striker bar; the improvement comprising:

a reservoir communicating with the first distributor and the second distributor; and a pneumatic motor gear rotatably mounted around the second distributor, said motor gear being mounted between a first plate and a second plate, wherein the piston of the percussion unit, the air motor gear, and the striker bar are axially aligned.

2. The improved pneumatic drill of claim 1 further comprising:

a back head attached to the first distributor defining said reservoir there between; and at least one air passageway communicating with said second distributor.

3. The improved pneumatic drill of claim 2 further comprising at least one air motor gear bearing interposed between said outer surface of the second distributor and the motor air gear mounted thereon.

4. The improved pneumatic drill of claim 3 wherein a centered air motor gear bearing is employed.

5. The improved pneumatic drill of claim 4 further comprising:

an exhaust port opening into the main housing.

6. The improved pneumatic drill of claim 3 further comprising an air house of sufficient size to serve as said reservoir.

7. The improved pneumatic drill of claim 2 further comprising an air hose of sufficient size to serve as said reservoir.

8. The improved pneumatic drill of claim 1 further comprising:

at least one second distributor air passageway passing through the block communicating with the second distributor providing an air passage to said second distributor.

9. The improved pneumatic drill of claim 8 wherein said second distributor passages in said block communicate with said first distributor and serve as said reservoir.

10. The improved pneumatic drill of claim 1 further comprising an air hose of sufficient size to serve as said reservoir.

11. A valveless pneumatic rock drill comprising:

a cylinder block having a first end and a second end with a central cylinder passage there between;

a piston having a central section, a first stem section and a second stem section;

a first distributor having a first distributor passage there through slidably engaging said first stem section, said first distributor attached to said first end of said block;

a first air gate in said first distributor passage;

a second distributor having a second distributor passage there through slidably engaging said second stem section, said positioned at the second end of said block;

a second air gate in said second distributor passage;

a first necked down region on said first stem section cooperating with said first gate to regulate air flow into said central cylindrical passage;

a second necked down region on said second stem section cooperating with said second gate to regulate air flow into said central cylindrical passage;

a first plate attaching said second distributor to said second end of said block;

an air motor overlapping said second distributor;

an air motor gear being mounted in said air motor with said air motor gear being positioned around and rotatably engaging said second distributor;

a drive gear engaging said air motor gear and enclosed in said air motor;

a main housing attached to said air motor;

a pinion gear connected to said drive gear and contained in said main housing;

a gear train engaging said pinion gear and housed in said main housing;

a chuck assembly rotatably mounted in said main housing; and a chuck gear mounted on said chuck and engaging said gear train.

* * * * *